US008987980B1

(12) United States Patent
Kita et al.

(10) Patent No.: US 8,987,980 B1
(45) Date of Patent: Mar. 24, 2015

(54) SPARK PLUG

(71) Applicant: NGK Spark Plug Co., Ltd., Nagoya (JP)

(72) Inventors: Jumpei Kita, Nagoya (JP); Haruki Yoshida, Tajimi (JP); Takamitsu Mizuno, Hashima (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 14/478,651

(22) Filed: Sep. 5, 2014

(30) Foreign Application Priority Data

Sep. 9, 2013 (JP) ..... 2013-185850

(51) Int. Cl.

| | |
|---|---|
| ***H01T 13/02*** | (2006.01) |
| ***H01T 13/08*** | (2006.01) |
| ***H01T 13/41*** | (2006.01) |
| ***H01T 13/32*** | (2006.01) |

(52) U.S. Cl.
CPC ..... *H01T 13/08* (2013.01); *H01T 13/41* (2013.01); *H01T 13/32* (2013.01)
USPC ..... 313/130; 313/143

(58) Field of Classification Search
CPC ..... H01T 13/32
USPC ..... 313/118–145
See application file for complete search history.

(56) References Cited

U.S. PATENT DOCUMENTS

| | | | | |
|---|---|---|---|---|
| 6,509,676 | B1 * | 1/2003 | Durling | 313/137 |
| 2010/0201245 | A1 * | 8/2010 | Miller et al. | 313/143 |
| 2012/0112620 | A1 * | 5/2012 | Lykowski et al. | 313/141 |
| 2013/0175922 | A1 * | 7/2013 | Yoshida et al. | 315/58 |

FOREIGN PATENT DOCUMENTS

| | | |
|---|---|---|
| JP | 09-63745 A | 3/1997 |
| JP | 2006-66086 A | 3/2006 |

* cited by examiner

*Primary Examiner* — Anne Hines
(74) *Attorney, Agent, or Firm* — Leason Ellis LLP

(57) ABSTRACT

A spark plug includes an insulator, a terminal electrode, a center electrode, a resistor, and a glass seal layer. The terminal electrode has: a recess part opened to the front end side and having a depth in a center axis direction of the terminal electrode; and a flat part neighboring the recess part at its outer circumference side. The relationship $0.52 \leq B/A \leq 0.91$ is satisfied, wherein A ($mm^2$) represents an area of a region surrounded by an outline of an outer circumference surface of the terminal electrode, and B ($mm^2$) which represents an area of a region of the terminal electrode surrounded by an outline of an inner surface of the recess part, in a cross section orthogonal to the center axis and located 0.1 mm away from a front end along the center axis to the rear end side.

6 Claims, 7 Drawing Sheets

SPARK PLUG

This application claims priority from Japanese Patent Application No. 2013-185850 filed with the Japan Patent Office on Sep. 9, 2013, the entire content of which is hereby incorporated by reference.

BACKGROUND OF THE INVENTION

1. Field of the Invention

The present disclosure relates to a spark plug used for an internal combustion engine and the like.

2. Description of the Related Art

A spark plug used for an internal combustion engine and the like has a cylindrical insulator having an axial hole, a center electrode inserted in the front end side of the axial hole, a terminal electrode inserted in the rear end side of the axial hole, and a cylindrical metallic shell provided to the outer circumference of the insulator. Further, the rear end of the terminal electrode inserted in the axial hole is exposed from the rear end of the insulator. Further, the front end of the terminal electrode is fixed to the insulator by a glass seal layer containing a conductive material and glass. In addition, a resistor for suppressing an electromagnetic wave noise that may occur in response to the operation of the internal combustion engine and the like is often provided between the center electrode and the terminal electrode inside the axial hole (see, for example, JP-A-2006-66086).

Further, in general, the glass seal layer and the resistor are formed as follows. A glass powder mixture, which is the component of the glass seal layer, containing glass powder and a conductive material is prepared in advance. Furthermore, a resistor composition, which is the component of the resistor, containing glass powder, a conductive material (such as a carbon black), and ceramic particles is prepared in advance. Then, after the center electrode is inserted in the front end side of the axial hole, the glass powder mixture and the resistor composition are filled up in the axial hole. At this time, the resistor composition and then the glass powder mixture are filled in this order. Next, the front end of the terminal electrode is inserted in the axial hole, and the terminal electrode is pressed toward the center electrode side in a heat. Thereby, the glass powder mixture is heated being directly compressed by the terminal electrode, and the resistor composition is heated being compressed via the glass powder mixture. Then, the glass powder mixture and the resistor composition are cooled and thus solidified. Thereby, the glass seal layer and the resistor are formed.

By the way, the insufficient compression of the glass powder mixture may cause a number of pores to be formed within the glass seal layer. In such a case, the density of the glass seal layer may decrease, which results in a smaller contact area per unit area between the terminal electrode and the glass seal layer. The smaller contact area causes the reduction in the fixing strength of the terminal electrode to the insulator via the glass seal layer. As a result, when an impact is applied to the terminal electrode and the insulator, the terminal electrode may easily fall out from the insulator. Further, at the impact, a gap is easily formed between the terminal electrode and the glass seal layer, which may cause a sudden increase of the resistance between the terminal electrode and the center electrode.

Further, the insufficient compression of the glass powder mixture may cause insufficient compression of the resistor composition to be compressed via the glass powder mixture. In such a case, the formation of a number of pores may cause a reduction in the density of the resistor. The resistor with a smaller density causes fewer conductive paths formed by the conductive material from the rear end side (the terminal electrode side) to the front end side (the center electrode side). Therefore, a part of the conductive paths is oxidized according to the usage, so that the resistance of the conductive paths may shapely increase. As a result, the load life property of the spark plug is degenerated.

In order to overcome the above-described disadvantages, the art in which a recess part is provided at the front end of the terminal electrode has been proposed (see, for example, JP-A-9-63745). According to this art, at the compression of the glass powder mixture, the glass powder mixture is less likely to move around to the outer circumference of the terminal electrode due to the presence of the recess part. This allows a larger pressure to be applied to the glass powder mixture from the terminal electrode. As a result, the glass powder mixture and the resistor composition can be sufficiently compressed, which allows for higher densities of the glass seal layer and the resistor.

SUMMARY OF THE INVENTION

A spark plug of the present invention includes: an insulator having an axial hole penetrating the insulator in an axial line direction; a terminal electrode inserted in a rear end side of the axial hole; a center electrode inserted in a front end side of the axial hole; a resistor disposed between the terminal electrode and the center electrode within the axial hole and containing a conductive material and glass; and a glass seal layer disposed in the rear end side than the resistor within the axial hole, contacting with a front end of the terminal electrode, and containing a conductive material and glass. The terminal electrode has, at its front end: a recess part opened to the front end side and having a depth of 0.3 mm or greater in a center axis direction of the terminal electrode; and a flat part neighboring the recess part at its outer circumference side. $0.52 \leq B/A \leq 0.91$ is satisfied, where A ($mm^2$) represents an area of a region surrounded by an outline forming an outer circumference surface of the terminal electrode, and B ($mm^2$) represents an area of a region of the terminal electrode surrounded by an outline of an inner surface forming the recess part in a cross section of the terminal electrode, the cross section being orthogonal to the center axis and located 0.1 mm away from a front end along the center axis to the rear end side.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
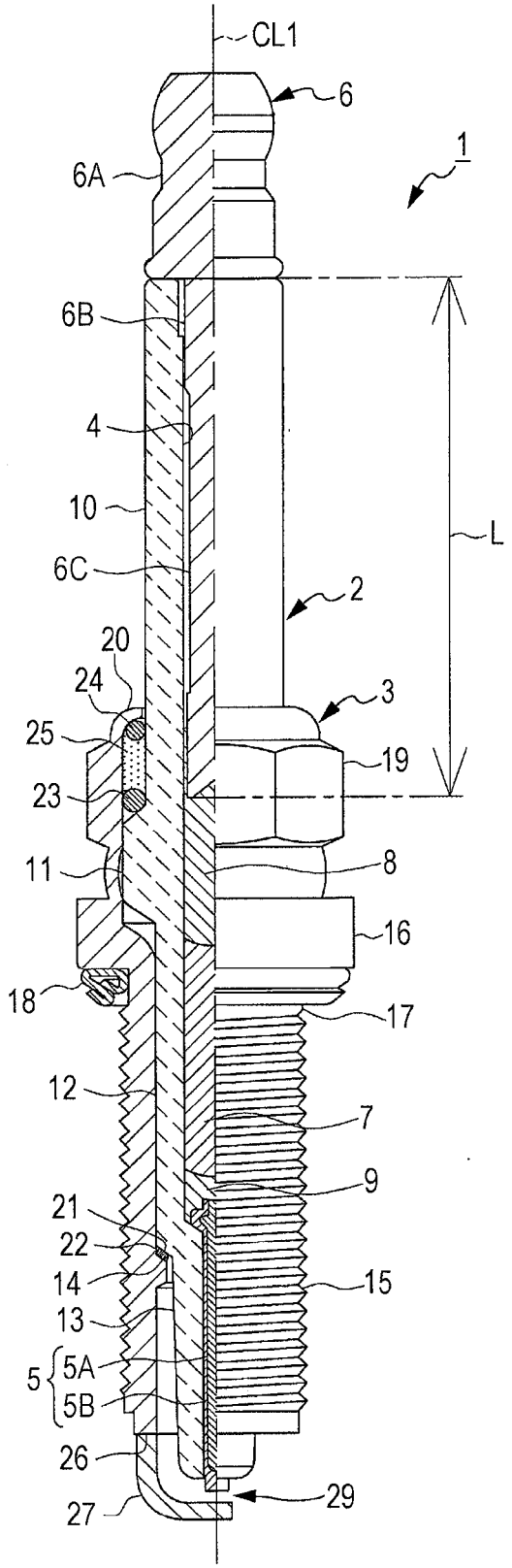
FIG. 1 is a partial sectional plane view showing a configuration of a spark plug.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the art of above-described JP-A-9-63745, there may be an excessive decrease in the amount of the glass powder mixture which moves around to the outer circumference side of the terminal electrode. This causes an insufficient fixing strength of the terminal electrode to the insulator, which may result in the reduction of the impact resistance.

One of the purposes of the present disclosure is to provide a spark plug that is able to ensure good performance in both load life property and impact resistance.

The configurations according to embodiments of the present disclosure will be described below for respective items. It is noted that, together with the configuration, the effects and advantages specific to that configuration will be further described if necessary.

Configuration 1. A spark plug in this configuration includes: an insulator having an axial hole penetrating the insulator in an axial line direction; a terminal electrode inserted in a rear end side of the axial hole; a center electrode inserted in a front end side of the axial hole; a resistor disposed between the terminal electrode and the center electrode within the axial hole and containing a conductive material and glass; and a glass seal layer disposed in the rear end side than the resistor within the axial hole, contacting with a front end of the terminal electrode, and containing a conductive material and glass. The terminal electrode has, at its front end: a recess part opened to the front end side and having a depth of 0.3 mm or greater in a center axis direction of the terminal electrode; and a flat part neighboring the recess part at its outer circumference side, $0.52 \leq B/A \leq 0.91$ is satisfied, where A ($mm^2$) represents an area of a region surrounded by an outline forming an outer circumference surface of the terminal electrode, and B ($mm^2$) represents an area of a region of the terminal electrode surrounded by an outline of an inner surface forming the recess part in a cross section of the terminal electrode, the cross section being orthogonal to the center axis and located 0.1 mm away from a front end along the center axis to the rear end side.

It is noted that the area A is substantially the same as the area of the region surrounded by the outline defining the front end face of the terminal electrode. Further, the area B is substantially the same as the opening area of the recess part in the front end of the terminal electrode. In the above-described configuration 1, both areas A and B are sectional areas located 0.1 mm away from the front end of the terminal electrode to the rear end side. This is to allow for more accurate area measurement taking into consideration of the groove such as the knurling tool formed on the outer circumference surface of the terminal electrode and the deformation of the terminal electrode at the pressing of the glass powder mixture.

According to the above-described configuration 1, the recess part is provided to the front end of the terminal electrode. Furthermore, the terminal electrode is configured so as to satisfy $0.52 \leq B/A$. Therefore, this can ensure to prevent or suppress an excessive larger amount of the glass powder mixture which moves around to the outer circumference side of the terminal electrode (to the gap between the outer circumference surface of the terminal electrode and the inner circumference surface of the insulator) at the compression of the glass powder mixture by the terminal electrode. Thus, a larger pressure can be applied to the glass powder mixture and further the resistor composition, which allows for sufficiently increased densities of both glass seal layer and resistor. Therefore, the fixing strength of the terminal electrode to the insulator via the glass seal layer can be improved, so that a good impact resistance can be achieved in the spark plug. Further, the gap is less likely to be formed between the terminal electrode and the glass seal layer even when vibration is applied and it can be ensured that many conductive paths can be formed within the resistor. As a result, a good load life property can be achieved in the spark plug.

Moreover, when the current flows between the terminal electrode and the center electrode via the resistor, the current easily flows in the part located in the inner circumference surface side (the outer circumference part of the resistor) of the resistor, in particular. Therefore, the resistance is more likely to increase in the outer circumference part of the resistor in response to the current conduction.

In this regard, according to the above-described configuration 1, since the terminal electrode is configured so as to satisfy $B/A \leq 0.91$, the sufficient area of the flat part is secured. Thus, the part located in the outer circumference side of the resistor composition can be further firmly compressed by the flat part of the terminal electrode. Therefore, the density at the outer circumference part of the resistor can be significantly increased. As a result, a further superior load life property can be achieved in the spark plug.

Further, $B/A \leq 0.91$ is satisfied. Therefore, when the glass powder mixture is compressed by the terminal electrode, a certain amount of the glass powder mixture moves around to the outer circumference side of the terminal electrode. Thus, the glass seal layer exists over a relatively wide range in the gap between the outer circumference surface of the terminal electrode and the inner circumference surface of the insulator, so that the fixing strength of the terminal electrode to the insulator can be further enhanced. As a result, the load life property and the impact resistance of the spark plug can be improved in a more effective manner.

Configuration 2. In the spark plug in this configuration according to the configuration 1, the terminal electrode includes: a head portion exposed from a rear end of the insulator; a base portion extending from a front end of the head portion toward the front end side; and a small-diameter portion located in the front end side than the base portion and having an outer diameter that is smaller than an outer diameter of the base portion. $0.80 \leq C/D \leq 1.20$ is satisfied, where C (Hv) represents hardness in Vickers hardness of the base portion and D (Hv) represents hardness in Vickers hardness of the small-diameter portion.

It is noted that the surface of the small-diameter portion and the like has a part where a hardness change may occur due to the processing and the like in forming the recess part and so on. The terms "hardness of the base portion" and "hardness of the small-diameter portion" refer to the hardness measured at a part other than the above-described "part where a hardness change may occur" of the surface of the small-diameter portion and the like.

According to the configuration 2, the difference in the hardness of the base portion and the small-diameter portion is quite small. Therefore, the amplitude of the terminal electrode can be reduced even when, due to the impact thereto, the terminal electrode vibrates with respect to the front end of the terminal electrode held by the glass seal layer as the supporting point, for example. This more ensures to prevent or suppress the terminal electrode from contacting with the inner circumference surface of the insulator in response to the vibration of the terminal electrode. As a result, this further ensures the prevention or suppression of the damage of the insulator due to the contact of the terminal electrode, so that the impact resistance can be further improved in the spark plug.

Configuration 3. In the spark plug in this configuration according to the configuration 1 or 2, the terminal electrode includes a head portion exposed from a rear end of the insulator, and a length along the center axis direction from a front end of the head portion to the front end of the terminal electrode is greater than or equal to 50 mm.

In general, the longer the length from the front end of the head portion to the front end of the terminal electrode (that is, of the terminal electrode, the length of the part inserted in the axial hole) is, the less the pressure is likely to be applied to the glass powder mixture at the compression of the glass powder mixture. Therefore, the density of the glass seal layer or the resistor tends to be smaller and, therefore, the amplitude of the terminal electrode when the terminal electrode vibrates tends to be larger. That is, it has been difficult to have the good load life property and impact resistance in the spark plug with the large length from the front end of the head portion to the front end of the terminal electrode.

In this regard, according to the above-described configuration 3, since the length from the front end of the head portion to the front end of the terminal electrode is greater than or equal to 50 mm, there may be a concern of the reduction in the load life property and the impact resistance of the spark plug. However, such concern can be overcome by employing the above-described configuration 1 and so on. In other words, the above-described configuration 1 and so on is particularly useful for the spark plug with the length of 50 mm or more from the front end of the head portion to the front end of the terminal electrode.

Configuration 4. In the spark plug in this configuration according to any one of configurations 1 to 3, a thickness of the insulator is greater than or equal to 3.0 mm in a cross section that passes the front end of the terminal electrode and is orthogonal to the axial line.

When the part of the insulator which contacts with the outer circumference surface of the glass seal layer is excessively thick, a relatively longer cooling time is required for solidifying the glass powder mixture after the heating and compressing. However, a longer cooling time tends to cause pores inside the glass seal layer, which is likely to result in the reduction in the load life property and the impact resistance of the spark plug. That is, in the spark plug with a larger thickness of the part of the insulator contacting with the outer circumference surface of the glass seal layer, there has been a greater concern of the reduction in the load life property and the impact resistance.

In this regard, according to the above-described configuration 4, since the thickness of the insulator is greater than or equal to 3.0 mm at the cross section that passes the end of the terminal electrode and is orthogonal to the axial line, there may be a greater concern of the reduction in the load life property and the impact resistance of the spark plug. However, such concern can be overcome by employing the above-described configuration 1 and so on. In other words, the above-described configuration 1 and so on is particularly useful for the spark plug with the thickness of 3.0 mm or more of the part of the insulator contacting with the outer circumference surface of the glass seal layer.

Configuration 5. In the spark plug in this configuration according to any one of configurations 1 to 4, the conductive material is a metal and a content of the metal in the glass seal layer is greater than or equal to 50% by weight and less than or equal to 60% by weight.

When the content of the metal as the conductive material is excessively large in the glass powder mixture (the glass seal layer), the content of the glass in the glass powder mixture is relatively smaller. Therefore, when the pressure is applied to the glass powder mixture from the terminal electrode, the glass powder is less likely to be crushed. Therefore, the pores are likely to be formed within the glass seal layer, and the pressure applied to the resistor composition is reduced. As a result, the densities of the glass seal layer and the resistor tend to be reduced.

On the other hand, when the content of the metal as the conductive material is excessively small in the glass powder mixture (the glass seal layer), the content of the glass in the glass seal layer is relatively larger and thus the viscosity of the glass powder mixture is reduced at the heating. Therefore, when the pressure is applied from the terminal electrode, the glass powder mixture easily moves around to the outer circumference side of the terminal electrode, which may result in the reduced densities of the glass seal layer and the resistor.

In this regard, according to the above-described configuration 5, the content of the metal in the glass seal layer is greater than or equal to 50% by weight and less than or equal to 60% by weight. Therefore, the glass powder contained in the glass powder mixture is easily crushed at the compression by the terminal electrode, and the amount of the glass powder mixture moving around to the outer circumference side of the terminal electrode can be further optimized. This allows the glass powder mixture and the resistor composition to be further firmly compressed and allows the densities of the glass seal layer and the resistor to further increase. As a result, both of the load life property and the impact resistance can be further improved in the spark plug.

Configuration 6. In the spark plug in this present configuration according to any one of configurations 1 to 5, in a cross section including the axial line, a pore rate of the glass seal layer in a region is less than or equal to 0.92%. The region is surrounded by a first virtual line that passes the front end of the terminal electrode and is orthogonal to the axial line, a second virtual line that is located 1.0 mm away from the first virtual line to the front end side along the axial line and is orthogonal to the axial line, a third virtual line that passes a point 0.5 mm away from an intermediate point of two intersections, which are made by an outline of the axial hole and the first virtual line, to one side along a direction orthogonal to the axial line and extends in the axial line direction, and a fourth virtual line that passes a point 0.5 mm away from the intermediate point to the other side along the direction orthogonal to the axial line.

According to the above-described configuration 6, the pore rate at the part of the glass seal layer surrounded by the four virtual lines, that is, at the part of the glass seal layer located immediately close to the center of the front end face of the terminal electrode is less than or equal to 0.92%. Therefore, in addition to the outer circumference part of the glass seal layer and the resistor that is pressed by the flat part of the terminal electrode, the density of the center part of the glass seal layer and the resistor can be sufficiently increased. As a result, the load life property and the impact resistance of the spark plug can be improved in a further effective manner.

One embodiment will be described below by referring to the drawings. FIG. 1 is a partial sectional plane view showing a spark plug 1. In the following description, an axial line CL1 direction of the spark plug 1 in FIG. 1 defines the vertical direction, and the lower side defines the front end side of the spark plug 1 and the upper side defines the rear end side thereof.

The spark plug 1 is configured with a cylindrical insulator 2 as an insulating member, a cylindrical metallic shell 3 for holding it, and so on.

The insulator 2 is formed by sintering the alumina and the like as well known. The insulator 2 has a rear trunk portion 10, a large-diameter portion 11, an intermediate trunk portion 12, and an insulator nose portion 13. The rear trunk portion 10 is formed in the rear end side in the outline of the insulator 2. The large-diameter portion 11 is located in the front end side of the rear trunk portion 10 and formed protruded outward in the radial direction. The intermediate trunk portion 12 is located in the front end side of the large-diameter portion 11 and formed thinner than it. The insulator nose portion 13 is located in the front end side of the intermediate trunk portion 12 and formed thinner than it. Most of the large-diameter portion 11, the intermediate trunk portion 12, and the insulator nose portion 13 of the insulator 2 is accommodated inside the metallic shell 3. Further, a step part 14 tapering toward the front end side is formed at the connection part of the intermediate trunk portion 12 and the insulator nose portion 13. At the step part 14, the insulator 2 is latched to the metallic shell 3.

Furthermore, an axial hole 4 penetrating the insulator 2 is formed along the axial line CL1. Further, a center electrode 5 is inserted in and fixed to the front end side of the axial hole 4. The center electrode 5 includes an inner layer 5A containing a metal (for example, copper, copper alloy, or pure nickel (Ni)) that has superior thermal conductivity and an outer layer 5B containing an alloy whose main component is Ni. Further, the center electrode 5 has a bar-like shape (a cylindrical shape) as a whole. The front end of the center electrode 5 protrudes out of the front end of the insulator 2. It is noted that a chip containing a metal (for example, a metal containing Ir, Pt, or the like) that has superior abrasion resistance may be provided to the front end of the center electrode 5.

Furthermore, a bar-shaped terminal electrode 6 containing a predetermined metal (for example, low carbon steel) is inserted in and fixed to the rear end side of the axial hole 4. The terminal electrode 6 has a head portion 6A exposed from the rear end of the insulator 2, a base portion 6B, and a small-diameter portion 6C. The base portion 6B is a bar-shaped portion extending from the front end of the head portion 6A toward the front end side. The small-diameter portion 6C is located in the front end side of the base portion 6B. The outer diameter of the small-diameter portion 6C is smaller than the outer diameter of the base portion 6B. It is noted that a knurling is provided to the part contacting with at least a rear end side glass seal layer 8 described later of the outer circumference surface of the small-diameter portion 6C. This prevents the terminal electrode 6 (the small-diameter portion 6C) from falling out from the rear end side glass seal layer 8 (see FIG. 2). Further, in the present embodiment, the outer diameter near the front end face of the terminal electrode 6 is 84% to 97% of the inner diameter of the part of the axial hole 4 where the small-diameter portion 6C is inserted.

Furthermore, a cylindrical conductive resistor 7 is arranged between the center electrode 5 and the terminal electrode 6 in the axial hole 4. The resistor 7 suppresses the electromagnetic wave noise. The resistance of the resistor 7 differs depending on the specification of the spark plug. The resistance of the resistor 7 is, for example, 100Ω or higher. Further, the resistor 7 is formed by heating and sealing the resistor composition. The resistor composition may be, for example, a conductive material (for example, a carbon black), glass powder containing silicon dioxide ($SiO_2$) and boron oxide ($B_2O_5$), and ceramic particles (for example, zirconium oxide ($ZrO_2$) particles, titanium oxide ($TiO_2$), or the like).

In addition, the rear end side glass seal layer 8 (corresponding to "glass seal layer" of the present disclosure) with which the front end of the terminal electrode 6 (the small-diameter portion 6C) contact is provided between the rear end of the resistor 7 and the terminal electrode 6. Further, a front end side glass seal layer 9 is provided between the front end of the resistor 7 and the center electrode 5. Both glass seal layers 8 and 9 contain a conductive material (for example, graphite, copper, or the like) and glass as a filler, respectively. Thus, both glass layers 8 and 9 have conductivity (for example, the resistance is around a few hundred mΩ). Further, the terminal electrode 6 and the center electrode 5 are connected to each other via both glass seal layers 8 and 9 and the resistor 7. Furthermore, both electrodes 5 and 6 are fixed to the insulator 2 by both glass seal layers 8 and 9. It is noted that both glass seal layers 8 and 9 are formed by the glass powder mixture being heated. The glass powder mixture is prepared by mixing a conductive material and borosilicate glass powder.

In addition, the metallic shell 3 is formed in a cylindrical shape by a metal such as low carbon steel. Its outer circumference surface is formed with a thread portion (an external thread portion) 15 that is for attaching the spark plug 1 to the attachment hole of the combustion apparatus (for example, an internal combustion engine or a fuel cell reforming apparatus). Further, a flange-shaped seating portion 16 protruding outward is formed in the rear end side of the thread portion 15. A ring-shaped gasket 18 is fitted to a thread root 17 in the rear end of the thread portion 15. Furthermore, a tool engagement portion 19 having hexagonal cross section to which a tool such as a wrench is engaged when the metallic shell 3 is attached to the combustion apparatus is provided in the rear end side of the metallic shell 3. Furthermore, a crimping portion 20 for holding the insulator 2 is provided in the rear end of the metallic shell 3.

Further, a taper step part 21 for latching the insulator 2 is provided to the front end side inner circumference surface of the metallic shell 3. Further, the insulator 2 is inserted in the metallic shell 3 from its rear end side toward the front end side. The step part 14 of the insulator 2 is then latched to the step part 21 of the metallic shell 3. Under this state, the insulator 2 is fixed to the metallic shell 3 by crimping the rear end side opening of the metallic shell 3 inward in the radial direction, that is, by forming the above-described crimping portion 20. It is noted that an annular plate packing 22 is interposed between both step parts 14 and 21. This allows the air tightness within the combustion chamber to be maintained to prevent or suppress that the fuel gas enters the gap between the insulator nose portion 13 of the insulator 2 exposed in the combustion chamber and the inner circumference surface of the metallic shell 3 and leaks to the outside.

Furthermore, in order to have a more complete sealing by the crimping, substantially annular ring members 23 and 24 are interposed between the metallic shell 3 and the insulator 2 in the rear end side of the metallic shell 3, and powder of talc 25 is filled up between the ring members 23 and 24. That is, the metallic shell 3 holds the insulator 2 via the plate packing 22, the ring members 23 and 24, and the talc 25.

Further, a bar-shaped ground electrode 27 that is bent at its intermediate part so that its side surface of the front end faces the front end of the center electrode 5 is connected to the front end 26 of the metallic shell 3. Further, a spark discharge gap 29 is formed between the front end of the center electrode 5 and the front end of the ground electrode 27. A spark discharge is made at the spark discharge gap 29 in the direction substantially along the axial line CL1. It is noted that a chip containing the metal that is superior in the abrasion resistance may be provided to the part of the ground electrode 27 facing the front end of the center electrode 5.

Figure 2A:
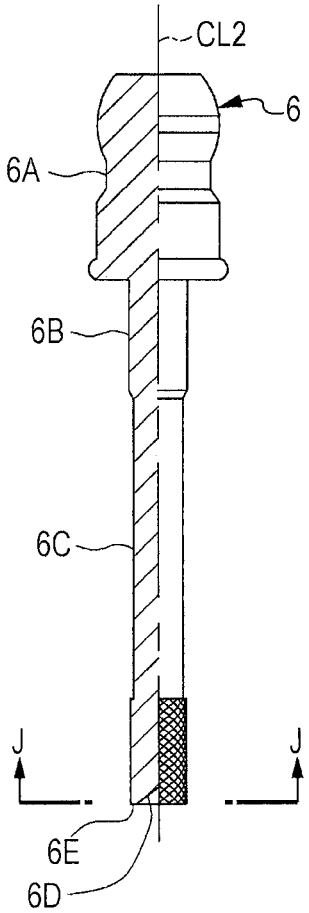
FIG. 2A is a partial sectional plane view showing a configuration of a terminal electrode.
Figure 2B:
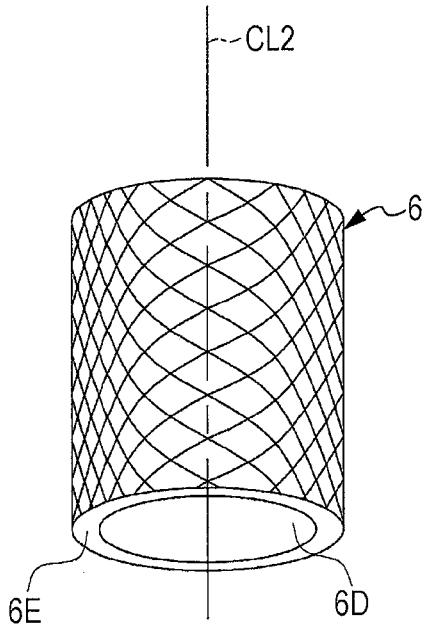
FIG. 2B is an expanded oblique view showing a configuration of a front end of the terminal electrode.

Furthermore, as shown in FIG. 2A and FIG. 2B, the terminal electrode 6 has, at its front end, a recess part 6D and a flat part 6E. The recess part 6D is opened to the front end side. The depth direction of the recess part 6D is the direction of a center axis CL2 of the terminal electrode 6 (it is noted that the center axis CL2 corresponds to the axial line CL1 in the present embodiment). The flat part 6E neighbors the recess part 6D at the outer circumference side of the recess part 6D. The flat part 6E extends in the direction substantially orthogonal to the center axis CL2. It is noted that "the direction orthogonal to the center axis CL2" refers not only to the direction strictly orthogonal to the center axis CL2 but also to the direction slightly inclined with respect to the direction orthogonal to the center axis CL2.

The recess part 6D is defined by the inner surface of the recess having a depth of 0.3 mm or greater in the center axis CL2 direction. Further, the recess part 6D is configured such that the cross section orthogonal to the center axis CL2 has substantially an annular shape. Further, the recess part 6D is shaped in a taper in the present embodiment. That is, the inner diameter of the recess part 6D gradually decreases along the center axis CL2 toward the rear end. It is noted that the depth of the recess part 6D is a predetermined value or less (for example, 1.0 mm or less) in the present embodiment.

The flat part 6E has an annular shape. The width of the flat part 6E along the direction orthogonal to the center axis CL2 is a predetermined value or greater (for example, 0.1 mm or greater).

Figure 3:
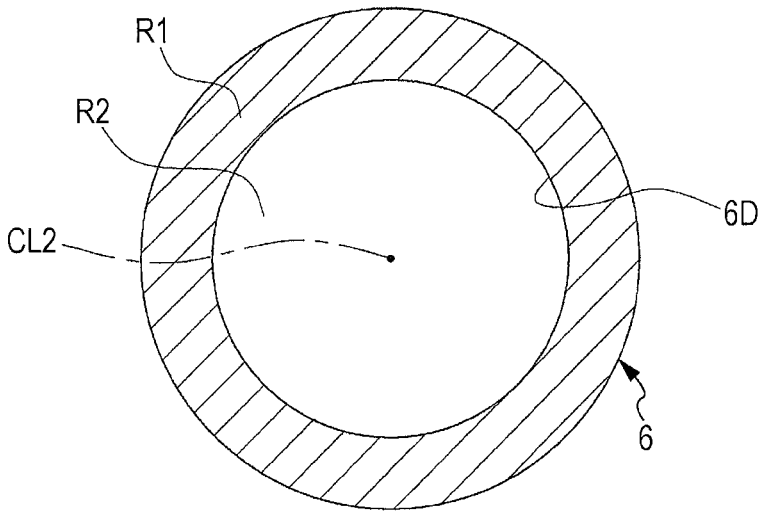
FIG. 3 is a sectional view cut along a line J-J of FIG. 2A.

Furthermore, FIG. 3 is a cross section cut along the J-J line of FIG. 2A. That is, FIG. 3 shows the cross section of the terminal electrode 6 that is orthogonal to the center axis CL2 and is located 0.1 mm away from the front end of the terminal electrode 6 along the center axis CL2 to the rear end side. In this case, the area of a region R1 (the region including a region R2 described later and a hatched region in FIG. 3) surrounded by the outline (the outer circumference of the cross section) forming the outer circumference surface of the terminal electrode 6 is defined as A ($mm^2$). The area of the region R2 surrounded by the outline (the inner perimeter of the cross section) of the inner surface forming the recess part 6D of the terminal electrode 6 is defined as B ($mm^2$). In this case, the areas A and B satisfy $0.52 \leq B/A \leq 0.91$. That is, the terminal electrode 6 is configured such that the recess part 6D secures the opening area with a proper size at the front end of the terminal electrode 6 and the width of the flat part 6E is not excessively small.

Furthermore, the hardness of the base portion 6B is denoted as C (Hv) in the Vickers hardness in the present embodiment. Also, the hardness of the small-diameter portion 6C is denoted as D (Hv) in the Vickers hardness. In this case, the hardness C and D satisfy $0.80 \leq C/D \leq 1.20$. It is noted that the surface of the base portion 6B and the small-diameter portion 6C has the part where a hardness change may occur due to the processing and the like in forming the recess part 6D, the knurling on that surface, or the like. In the present embodiment, the terms "hardness of the base portion 6B" or "hardness of the small-diameter portion 6C" refer to the hardness measured at a part other than the above-described "part where a hardness change may occur" of the surface of the base portion 6B or the small-diameter portion 6C. Further, the Vickers hardness can be measured based on the specification of JIS Z2244. Specifically, a predetermined weight (for example, 1.961 N) is applied to the base portion 6B and the small-diameter portion 6C by a regular square pyramid diamond indenter. Then, the hardness of the base portion 6B and the small-diameter portion 6C can be measured based on the diagonal length of the indentation formed on the terminal electrode 6 in response to the application of the weight.

Figure 4:
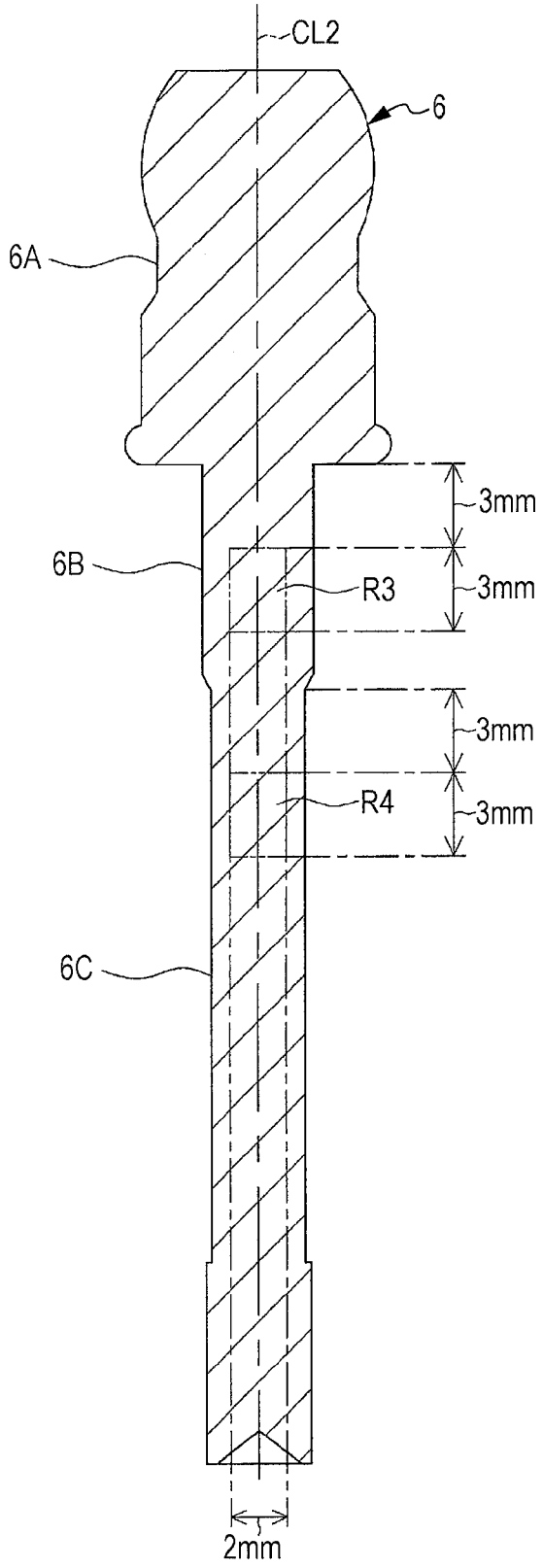
FIG. 4 an expanded sectional view for illustrating a measurement position in measuring hardness of a small-diameter portion or a base portion.

In addition, the hardness of the base portion 6B (the Vickers hardness C) can be the averaged hardness for ten points within a region R3 of the base portion 6B in the cross section of the base portion 6B including the center axis CL2 as shown in FIG. 4, for example. The region R3 is a region with the width of 2 mm and the length of 3 mm that is located 3 mm away from the front end of the head portion 6A along the center axis CL2 direction to the front end side. Also, the hardness of the small-diameter portion 6C (the Vickers hardness D) can be the averaged hardness for ten points within a region R4 of the small-diameter portion 6C in the cross section of the small-diameter portion 6C including the center axis CL2, for example. The region R4 is a region with the width of 2 mm and the length of 3 mm that is located 3 mm away from the front end of the base portion 6B along the center axis CL2 direction to the front end side.

In addition, the length L along the center axis CL2 from the front end of the head portion 6A to the front end of the terminal electrode 6 is greater than or equal to 50 mm (see FIG. 1).

Figure 5:
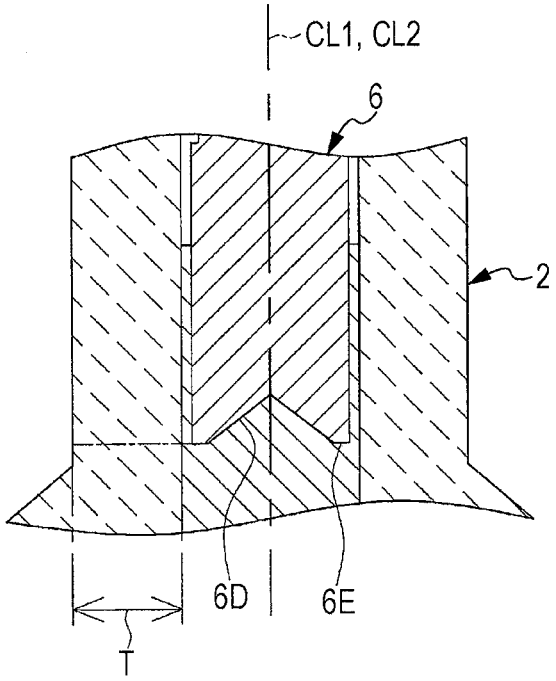
FIG. 5 is an expanded sectional view for illustrating a thickness T of an insulator.

Furthermore, as shown in FIG. 5, the thickness T of the insulator 2 at the cross section of the spark plug that passes the front end of the terminal electrode 6 and is orthogonal to the axial line CL1 is greater than or equal to 3.0 mm. It is noted that, in the well-known spark plug, the thickness T of the insulator 2 is typically 2.5 mm or less.

In addition, the conductive material contained in the rear end side glass seal layer 8 is a metal. The content of the conductive metal in the rear end side glass seal layer 8 is greater than or equal to 50% by weight and less than or equal to 60% by weight.

Figure 6:
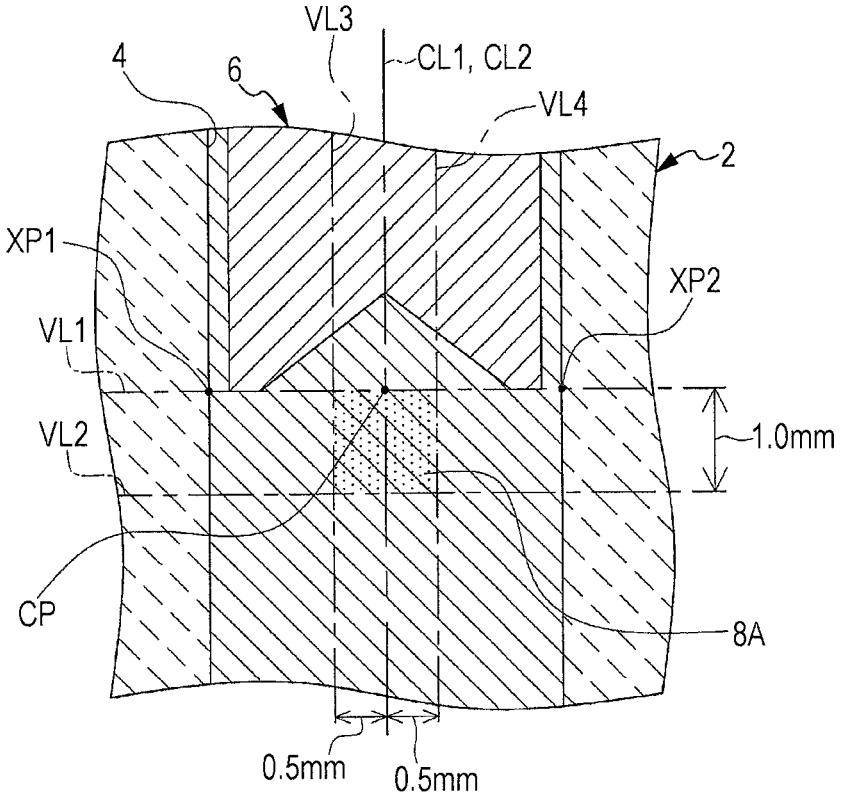
FIG. 6 is an expanded sectional view showing a recess facing part and its peripheral.

Further, as shown in FIG. 6, the pore rate of a recess facing part 8A of the rear end side glass seal layer 8 is less than or equal to 0.92%. The recess facing part 8A is a part that is located in more front end side than the center part of the front end face of the terminal electrode 6 (that is, the part that is pressed by the surface of the terminal electrode 6 defining the recess part 6D and is depicted with hatching of the dotted pattern in FIG. 6). It is noted that the recess facing part 8A refers to the part of the rear end side glass seal layer 8 located within the region surrounded by a first virtual line VL1, a second virtual line VL2, a third virtual line VL3, and a fourth virtual line VL4 described later, respectively. The first virtual line VL1 is a line that passes the front end of the terminal electrode 6 and is orthogonal to the axial line CL1. The second virtual line VL2 is a line that orthogonally intersects the axial line CL1 at the point 1.0 mm away from the first virtual line VL1 to the front end side along the axial line CL1. The third virtual line VL3 is a line that passes the point 0.5 mm away from the intermediate point CP of two intersections XP1 and XP2, which are made by the outline of the axial hole 4 and the first virtual line VL1, to one side along the direction orthogonal to the axial line CL1 and extends in the axial line CL1 direction. The fourth virtual line VL4 is a line that passes the point 0.5 mm away from the intermediate point CP to the other side along the direction orthogonal to the axial line CL1 and extends in the axial line CL1 direction.

Further, the pore rate can be measured by the following scheme. Specifically, the rear end side glass seal layer 8 is cut along the axial line CL1 at the position passing the recess facing part 8A. Furthermore, a mirror polishing is applied to the cut surface. Then, the image including the entire polished surface is obtained by an SEM observation on the polished surface (for example, the acceleration voltage of 20 kV, the spot size of 50, the COMPO image, the composite image). The area ratio of the pore part is then measured from the obtained image. Thereby, the pore rate can be obtained.

It is noted that the pore rate of the recess facing part 8A can be changed by adjusting the press length in the hot press process described later. For example, a larger press length results in a reduction of the pore rate of the recess facing part 8A, while a smaller press length results in an increase of the pore rate of the recess facing part 8A.

Next, described will be a manufacturing method of the above-described spark plug 1.

First, the metallic shell 3 is processed in advance. That is, the outline and through hole is formed to a cylindrical metal material (for example, an iron-based material or a stainless-based material) by a cold forging processing and the like. The outline of the forged material is then arranged by a cutting work to obtain a metallic shell intermediate.

Next, a straight bar-shaped (needle-shaped) ground electrode 27 containing Ni alloy is resistance-welded to the front end face of the metallic shell intermediate. In the resistance welding, so-called "droop" occurs. After the "droop" is removed, the thread portion 15 is formed to a predetermined part of the metallic shell intermediate by a rolling. Thereby, the metallic shell 3 where the ground electrode 27 has been welded is obtained.

Next, a zinc plating or a Ni plating is applied to the metallic shell 3 where the ground electrode 27 has been welded. It is noted that, in order to improve the corrosion resistance, a chromate process may be applied to the surface.

On the other hand, a forming process is applied to the insulator 2 in advance apart from the metallic shell 3. For example, base stock granulated particles are prepared by using alumina-based raw material powder containing binder and so on. Furthermore, a rubber press forming is made by using the base stock granulated particles to obtain the cylindrical compact. The obtained compact is then shaped by a grinding. The shaped compact is sintered in the baking furnace to obtain the insulator 2.

Further, the center electrode 5 is manufactured in advance apart from the metallic shell 3 and the insulator 2. Specifically, the center electrode 5 is fabricated by forging Ni alloy in which copper alloy is arranged in the center for improving the heat dissipation.

Further, the terminal electrode 6 is fabricated in advance. Specifically, the terminal electrode 6 having the recess part 6D and the flat part 6E at its front end is fabricated by applying a forging processing and a cutting work to the bar-shaped member containing low carbon stainless. It is noted that the terminal electrode 6 is fabricated so that $0.80 \leq C/D \leq 1.20$ is satisfied where the hardness of the base portion 6B is C (Hv) in the Vickers hardness and the hardness of the small-diameter portion 6C is D (Hv) in the Vickers hardness.

Furthermore, a powder resistor composition for forming the resistor 7 is prepared in advance. More specifically, a conductive material (for example, a carbon black), glass powder, ceramic particles, and a predetermined binder are combined and the compound is then mixed with water as a medium. Then, the slurry obtained by this mixture is dried. The glass powder is mixed and stirred into the dried slurry to obtain the resistor composition.

Next, the resistor 7 is provided within the axial hole 4 by a hot press process. Furthermore, the center electrode 5 and the terminal electrode 6 are sealed and fixed to the insulator 2 by the glass seal layers 8 and 9.

Figure 7A:
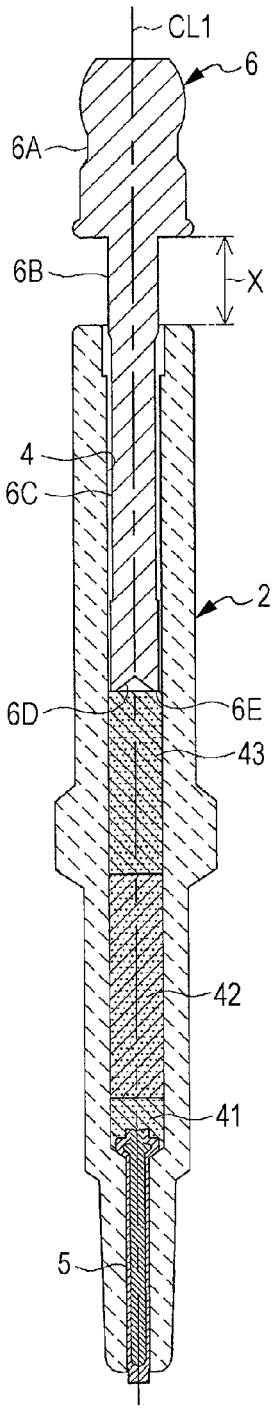
FIG. 7A, FIG. 7B and FIG. 7C are sectional views showing respective processes of a hot press process.

More specifically, as shown in FIG. 7A, the center electrode 5 is inserted in the front end side of the axial hole 4. Next, the axial hole 4 is filled up with a glass powder mixture 41 that has been prepared by mixing borosilicate glass and conductive metal powder, and the filled glass powder mixture 41 is then pre-compressed. Next, the resistor composition 42 is filled up in the axial hole 4 and then similarly pre-compressed. Furthermore, a glass powder mixture 43 is filled up in the axial hole 4 and then similarly pre-compressed. Next, the small-diameter portion 6C and the base portion 6B of the terminal electrode 6 are inserted in the axial hole 4, and the terminal electrode 6 is placed on the glass powder mixture 43. At this time, in order to improve the load life property of the resistor 7, the press length X of the resistor composition 42 and the like is set sufficiently long. The press length X is the size of a gap formed between the front end of the head portion 6A and the rear end of the insulator 2. It is noted that the press length X is not set to constant in a strict sense and a certain degree of variation within a predetermined range is tolerated. The press length X is set to such a size that allows the pore rate of the recess facing part 8A to be 0.92% or less, for example.

Figure 7B:
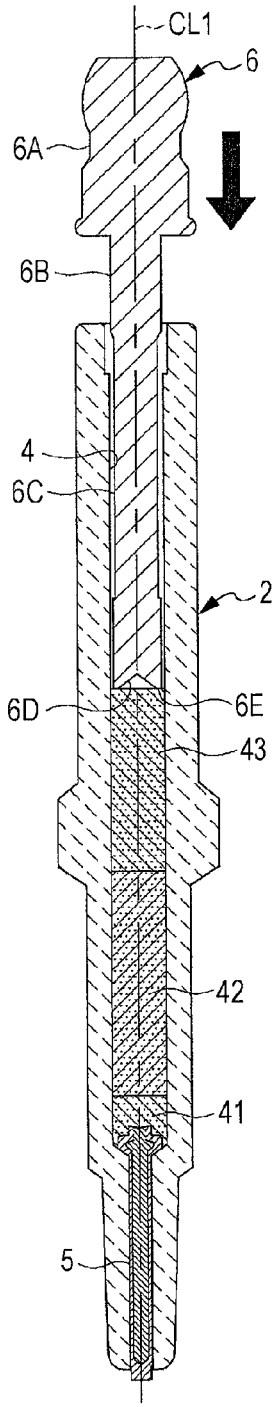

Under this state, as shown in FIG. 7B, the terminal electrode 6 is pressed toward the front end side in the axial line CL1 direction. In this state, the glass powder mixtures 41 and 43 and the resistor composition 42 are heated inside the baking furnace at a predetermined target temperature (for example, 900 degrees centigrade) above the glass softening point. At this time, the recess part 6D exists at the front end of the terminal electrode 6 and $B/A \leq 0.91$ is satisfied. Therefore, at the pressing by the terminal electrode 6, a certain amount of the glass powder mixture 43 moves around to the outer circumference side of the terminal electrode 6. Since $0.52 \leq B/A$ is satisfied, however, the amount of the glass powder mixture 43 moving around is not excessively large. Thus, a large pressure is applied from the terminal electrode 6 to the glass powder mixture 43 and, as a result, a large pressure is applied to the resistor composition 42. Further, the front end of the terminal electrode 6 is provided to the flat part 6E, which allows a particularly large pressure to be applied to the part of the glass powder mixture 43 located in the inner circumference surface side of the insulator 2 (the part located in the outer circumference side of the glass powder mixture 43). As a result, the part located in the outer circumference side of the resistor composition 42 is further firmly compressed.

Figure 7C:
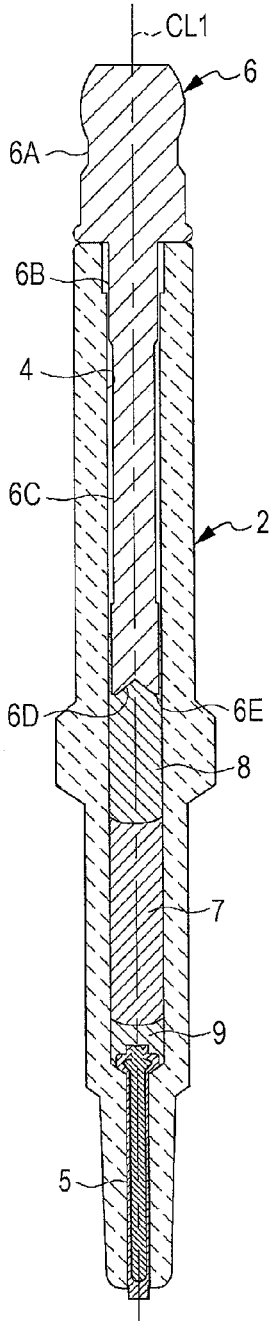

The stacked resistor composition 42 and glass powder mixtures 41 and 43 are heated and compressed. Then, the resistor composition 42 and the glass powder mixtures 41 and 43 are cooled for a predetermined time to form the resistor 7 and the glass seal layers 8 and 9, as shown in FIG. 7C.

It is noted that, in the hot press process, the glass powder mixture 43 moves around to the outer circumference side of the terminal electrode 6 to a certain degree. Therefore, the rear end side glass seal layer 8 exists over a relatively wide range along the axial line CL1 direction in the gap between the outer circumference surface of the terminal electrode 6 and the inner circumference surface of the insulator 2. Further, since a large pressure is applied to the glass powder mixture 43 and further the resistor composition 42, the pores are less likely to be formed in the resistor 7 and the rear end side glass seal layer 8 and, therefore, the densities of the resistor 7 and the rear end side glass seal layer 8 further increase. In particular, a larger pressure is applied to the part located in the outer circumference side of the resistor composition 42, which results in a higher density in the part located in the outer circumference side of the resistor 7. It is noted that, when a current flows between the terminal electrode 6 and the center electrode 5, the current tends to run and flow on the inner circumference surface of the insulator 2. That is, the part located in the outer circumference side of the resistor 7 is likely to become the conductive path. That is, the present embodiment allows for significant improvement of the density of the part of the outer circumference side of the resistor 7, the part being likely to make the conductive path and is likely to be oxidized (the resistance is likely to increase). Thus, the spark plug is configured so that the resistance in response to the current conduction is less likely to increase. It is noted that, in the hot press process, the glaze layer may be sintered on the surface of the rear trunk portion 10 of the insulator 2 at the same time. Alternatively, the glaze layer may be formed in advance on the surface.

Then, the insulator 2 having the center electrode 5 and the resistor 7 fabricated as described above is fixed to the metallic shell 3 having the ground electrode 27. More specifically, after the insulator 2 is inserted in the metallic shell 3, the insulator 2 and the metallic shell 3 are fixed to each other by crimping the rear end side opening of the metallic shell 3 formed relatively thin in the radial direction, that is, by forming the above-described crimping portion 20.

Finally, the above-described spark plug 1 is obtained by bending the intermediate part of the ground electrode 27 toward the center electrode 5 and adjusting the size of the spark discharge gap 29 formed between the center electrode 5 and the ground electrode 27.

As described above in detail, according to the present embodiment, the recess part 6D is provided to the front end of the terminal electrode 6 and it is configured so as to satisfy $0.52 \leq B/A$. Therefore, this more ensures to prevent or suppress the excessively large amount of the glass powder mixture 43 which moves around to the outer circumference side of the terminal electrode 6 at the compressing of the glass powder mixture 43 by the terminal electrode 6. This allows a large pressure to be applied to the glass powder mixture 43 and further the resistor composition 42. Thus, both densities of the rear end side glass seal layer 8 and the resistor 7 can be sufficiently increased. Therefore, the fixing strength of the terminal electrode 6 to the insulator 2 via the rear end side glass seal layer 8 can be improved, so that a good impact resistance can be achieved in the spark plug 1. Further, even when the vibration is applied, the gap is less likely to be formed between the terminal electrode 6 and the rear end side glass seal layer 8, and it is thus further ensured that many conductive paths are formed within the resistor 7. As a result, a good load life property can be achieved in the spark plug 1.

Furthermore, since the terminal electrode 6 is configured so as to satisfy $B/A \leq 0.91$, the area of the flat part 6E is sufficiently secured. Thus, the part located in the outer circumference side of the resistor composition 42 can be more firmly compressed by the flat part 6E, which allows for significant increase in the density of the outer circumference part of the resistor 7 where the increase of the resistance in response to the current conduction is more likely to occur. As a result, a further superior load life property can be achieved in the spark plug 1.

Further, since $B/A \leq 0.91$ is satisfied, a certain amount of the glass powder mixture 43 moves around to the outer circumference side of the terminal electrode 6 when the glass powder mixture 43 is compressed by the terminal electrode 6. Therefore, the rear end side glass seal layer 8 exists over a relatively wide range in the gap between the outer circumference surface of the terminal electrode 6 and the inner circumference surface of the insulator 2, so that the fixing strength of the terminal electrode 6 to the insulator 2 can be further enhanced. As a result, the load life property and the impact resistance can be more effectively improved in the spark plug 1.

In particular, in the present embodiment, the length L from the front end of the head portion 6A to the front end of the terminal electrode 6 is 50 mm or greater and the thickness T of the insulator 2 is 3.0 mm or greater, which could make it quite difficult to have good load life property and impact resistance. However, the load life property and the impact resistance of the spark plug can be sufficiently enhanced by the features that the recess part 6D is provided to the front end of the terminal electrode 6 and that $0.52 \leq B/A \leq 0.92$ is satisfied.

In addition, the terminal electrode 6 of the spark plug 1 according to the present embodiment is configured to satisfy $0.80 \leq C/D \leq 1.20$. That is, the difference in the hardness between the base portion 6B and the small-diameter portion 6C is quite small. Thus, the amplitude of the terminal electrode 6 can be reduced even when the terminal electrode 6 vibrates due to the application of impact and the like. This further ensures to prevent or suppress the terminal electrode 6 from contacting with the inner circumference surface of the insulator 2 in response to the vibration of the terminal electrode 6. As a result, this further ensures to prevent or suppress the damage of the insulator 2 due to the contact of the terminal electrode 6, so that the impact resistance can be further improved in the spark plug.

Furthermore, the metal content of the rear end side glass seal layer 8 is 50% by weight to 60% by weight. This allows the glass powder in the glass powder mixture 43 to be easily crushed at the compression by the terminal electrode 6 and allows the proper amount of the glass powder mixture 43 to move around to the outer circumference side of the terminal electrode 6. Therefore, the glass powder mixture 43 and the resistor composition 42 can be further firmly compressed, so that the densities of the rear end side glass seal layer 8 and the resistor 7 can be further increased. As a result, both of the load life property and the impact resistance can be further improved in the spark plug 1.

In addition, the pore rate in the recess facing part 8A of the rear end side glass seal layer 8 is 0.92% or less. Therefore, in addition to the density of the outer circumference part of the rear end side glass seal layer 8 and the resistor 7 pressed by the flat part 6E, the density in the center part of the rear end side glass seal layer 8 and the resistor 7 can be sufficiently increased. As a result, the load life property and the impact resistance can be more effectively improved in the spark plug 1.

Next, in order to confirm the effects and advantages provided by the above-described embodiment, prepared were samples of the spark plug that have different B/A, C/D, length L (mm), thickness T (mm) of the insulator, content (% by weight) of the metal in the rear end side glass seal layer, and pore rate (%) in the recess facing part. For respective samples, the evaluation test of the load life property and the evaluation test of the impact resistance were made.

The outline of the evaluation test of the load life property is as follows. Each sample was attached to the transistor ignition device used for automobiles and was discharged for 3600 times per minute at a temperature of 350 degrees centigrade and at a discharge voltage of 20 kV. The time from the start of the discharge (the life time) was measured that was required for the resistance at a normal temperature to reach 100 kΩ.

The load life property of each sample was then evaluated with ten grades according to the scores depending on the life time. Here, with respect to the score, the sample whose life time is less than 150 hours is scored as "1" and the sample whose life time is greater than or equal to 150 hours and less than 200 hours is scored as "2". Then, one point is added as the life time increases by 50 hours (for example, the score of the sample whose life time is greater than or equal to 300 hours and less than 350 hours is scored as "5"). The sample whose life time exceeds 550 hours is scored as "10". It can be said that the sample having a higher score is less likely to exhibit the increase of the resistance in response to the current conduction and has a better load life property. Specifically, it can be determined that the sample having the score of "6" or greater has the good load life property.

Further, the outline of the evaluation test of the impact resistance is as follows. Ten samples each having the same B/A and C/D and the like were prepared. Each sample was attached to an L-shape bush, and impacts were then applied to the sample for 400 times per minute by the stroke of 22 mm by the impact tester specified under JIS B8031, 7.4. After ten minutes have elapsed, it was confirmed whether or not the terminal electrode is normally fixed to the insulator, whether or not there is damage of the insulator due to the contact by the terminal electrode, and so on to determine whether or not there is an abnormality. Furthermore, the number of the samples in which no abnormality occurred out of ten samples was evaluated as a score. For example, the score in the case where no abnormality occurred in five out of ten samples is "5". Further, the score in the case where no abnormality occurred in any of ten samples is "10". It can be said that the sample having a higher score is less likely to exhibit the abnormality due to the impact. Specifically, it can be determined that the sample having the score of "2" or greater has the good impact resistance.

Table 1 shows the results of both tests. It is noted that the hardness C of the base portion is the averaged hardness for ten points selected on the surface of the base portion. The hardness D of the small-diameter portion is the averaged hardness for ten points selected on the surface of the small-diameter portion. In each sample, the inner diameter of the part of the axial hole where the resistor is arranged is 3.9 mm.

TABLE 1

| No. | A ($mm^2$) | B ($mm^2$) | B/A | C/D | Length L (mm) | Insulator thickness T (mm) | Conductive metal content (% by weight) | Pore rate (%) | Evaluation: Load life property | Evaluation: Impact resistance |
|---|---|---|---|---|---|---|---|---|---|---|
| 1 | 3.3 | 1.3 | 0.39 | 0.70 | 40.0 | 3.3 | 48.0 | 1.21 | 5 | 0 |
| 2 | 3.3 | 1.3 | 0.39 | 0.70 | 50.0 | 3.3 | 48.0 | 1.21 | 2 | 0 |
| 3 | 3.3 | 1.3 | 0.39 | 0.70 | 64.0 | 3.3 | 48.0 | 1.21 | 2 | 0 |
| 4 | 3.3 | 1.3 | 0.39 | 1.00 | 50.0 | 2.5 | 48.0 | 1.02 | 5 | 5 |
| 5 | 3.3 | 1.3 | 0.39 | 1.00 | 50.0 | 3.0 | 48.0 | 1.02 | 4 | 4 |
| 6 | 3.3 | 1.3 | 0.39 | 1.00 | 50.0 | 3.5 | 48.0 | 1.02 | 4 | 4 |
| 7 | 3.3 | 3.3 | 1.00 | 0.70 | 50.0 | 3.3 | 48.0 | 0.98 | 4 | 0 |
| 8 | 3.3 | 1.7 | 0.52 | 0.70 | 50.0 | 3.3 | 48.0 | 1.12 | 6 | 2 |
| 9 | 3.3 | 3.0 | 0.91 | 0.70 | 50.0 | 3.3 | 48.0 | 1.01 | 6 | 2 |
| 10 | 3.3 | 2.3 | 0.70 | 0.70 | 40.0 | 3.3 | 48.0 | 1.02 | 6 | 2 |
| 11 | 3.3 | 2.3 | 0.70 | 0.70 | 50.0 | 3.3 | 48.0 | 1.02 | 6 | 2 |
| 12 | 3.3 | 2.3 | 0.70 | 0.70 | 64.0 | 3.3 | 48.0 | 1.02 | 6 | 2 |
| 13 | 3.3 | 2.3 | 0.70 | 1.00 | 50.0 | 2.5 | 48.0 | 1.02 | 6 | 6 |
| 14 | 3.3 | 2.3 | 0.70 | 1.00 | 50.0 | 3.0 | 48.0 | 1.02 | 6 | 6 |
| 15 | 3.3 | 2.3 | 0.70 | 1.00 | 50.0 | 3.5 | 48.0 | 1.02 | 6 | 6 |
| 16 | 3.3 | 2.3 | 0.70 | 0.75 | 50.0 | 3.3 | 55.0 | 0.83 | 10 | 6 |
| 17 | 3.3 | 2.3 | 0.70 | 0.80 | 50.0 | 3.3 | 55.0 | 0.83 | 10 | 10 |
| 18 | 3.3 | 2.3 | 0.70 | 1.20 | 50.0 | 3.3 | 55.0 | 0.83 | 10 | 10 |
| 19 | 3.3 | 2.3 | 0.70 | 1.25 | 50.0 | 3.3 | 55.0 | 0.83 | 10 | 6 |
| 20 | 3.3 | 2.3 | 0.70 | 1.00 | 50.0 | 3.3 | 48.0 | 1.00 | 6 | 6 |
| 21 | 3.3 | 2.3 | 0.70 | 1.00 | 50.0 | 3.3 | 50.0 | 0.83 | 10 | 10 |
| 22 | 33 | 2.3 | 0.70 | 1.00 | 50.0 | 3.3 | 55.0 | 0.83 | 10 | 10 |
| 23 | 3.3 | 2.3 | 0.70 | 1.00 | 50.0 | 3.3 | 58.0 | 0.83 | 10 | 10 |
| 24 | 3.3 | 2.3 | 0.70 | 1.00 | 50.0 | 3.3 | 60.0 | 0.83 | 10 | 10 |
| 25 | 3.3 | 2.3 | 0.70 | 1.00 | 50.0 | 3.3 | 63.0 | 1.00 | 6 | 6 |
| 26 | 3.3 | 2.3 | 0.70 | 1.00 | 50.0 | 3.3 | 55.0 | 0.72 | 10 | 10 |
| 27 | 3.3 | 2.3 | 0.70 | 1.00 | 50.0 | 3.3 | 55.0 | 0.83 | 10 | 10 |
| 28 | 3.3 | 2.3 | 0.70 | 1.00 | 50.0 | 3.3 | 55.0 | 0.92 | 10 | 10 |
| 29 | 3.3 | 2.3 | 0.70 | 1.00 | 50.0 | 3.3 | 55.0 | 1.00 | 6 | 6 |
| 30 | 3.3 | 2.3 | 0.70 | 1.00 | 50.0 | 3.3 | 55.0 | 1.21 | 6 | 6 |

As indicated in Table 1, the samples (samples 1 to 6) whose B/A is less than 0.52 are inferior at least in the load life property. The following reasons can be considered. In these samples, the excessively large amount of the glass powder mixture moves around to the outer circumference side of the terminal electrode. Therefore, the pressure applied to the glass powder mixture or the resistor composition is reduced, which causes the reduced densities of the rear end side glass seal layer and the resistor.

Further, out of the samples whose load life property is insufficient, the samples (samples 1 to 3) in which the length L only is different are compared. It was confirmed that the load life property tends to be particularly insufficient in the samples (samples 2 and 3) having the length L of 50 mm or greater. It is considered that this is because, in the samples having the length L of 50 mm or greater, the pressure is less likely to be applied to the glass powder mixture from the terminal electrode and, as a result, many pores are formed in the rear end side glass seal layer and the resistor.

Further, out of the samples whose load life property is insufficient, the samples (samples 4 to 6) in which the thickness T of the insulator only is different are compared. It was confirmed that the load life property and the impact resistance tend to decrease in the samples (samples 5 and 6) having the thickness T of 3.0 mm or greater. It is considered that this is because long time is required to cool and solidify the glass powder mixture and, as a result, the pores are easily formed in the rear end side glass seal layer.

Furthermore, it was confirmed that the sample (sample 7) having the B/A value of 0.91 or greater is inferior in the load life property and the impact resistance. The following reasons can be considered. First, in these samples, the width of the flat part is quite small, which does not result in the significant increase in the density of the outer circumference part of the resistor where the increase in the resistance in response to the current conduction is likely to occur. Second, the glass powder mixture hardly moves around to the outer circumference side of the terminal electrode and therefore the contact area between the outer circumference surface and the terminal electrode and the rear end side glass seal layer is reduced, which results in an insufficient force for holding the terminal electrode by the rear end side glass seal layer.

In contrast, it became clear that the samples (samples 8 to 30) satisfying $0.52 \leq B/A \leq 0.91$ exhibit good load life property and impact resistance. The reasons for the good load life property are considered to be (1) and (2) as follows. The reasons for the good impact resistance are considered to be (3) and (4) as follows.

(1) Since there is a recess part in the front end of the terminal electrode and $0.52 \leq B/A$ is satisfied, the amount of the glass powder mixture moving around in the hot press process is not excessive. Therefore, a large pressure is applied to the glass powder mixture and the resistor composition, which results in the sufficiently increased density of the resistor.

(2) Since $B/A \leq 0.91$ is satisfied, the part of the resistor composition located in the outer circumference side is more firmly compressed by the flat part of the terminal electrode. This results in the significantly increased density of the outer circumference part of the resistor where the increase of the resistance in response to the current conduction would otherwise be particularly likely to occur.

(3) Since $0.52 \leq B/A$ is satisfied, the amount of the glass powder mixture moving around in the hot press process is not excessive. Therefore, a large pressure is applied to the glass powder mixture, which results in the sufficiently increased density of the rear end side glass seal layer and the sufficiently increased contact area per unit area between the terminal electrode and the rear end side glass seal layer.

(4) Since $B/A \leq 0.91$ is satisfied, a certain amount of the glass powder mixture moves around to the outer circumference side of the terminal electrode in the hot press process. Therefore, the rear end side glass seal layer exists over the relatively wide region in the gap between the outer circumference surface of the terminal electrode and the inner circumference surface of the insulator, which results in the increased holding force of the terminal electrode by the rear end side glass seal layer.

Furthermore, out of the samples satisfying $0.52 \leq B/A \leq 0.91$, the samples (samples 10 to 12) in which the length L only is different are compared. Even in the samples (samples 11 and 12) where the reduction of the load life property is concerned because of the length L of 50 mm or greater, it was confirmed that the superior load life property was achieved similarly to the sample (sample 10) whose length L is less than 50 mm.

In addition, out of the samples satisfying $0.52 \leq B/A \leq 0.91$, the samples (samples 13 to 15) in which the thickness T of the insulator only is different are compared. Even in the samples (samples 14 and 15) where the reduction of the load life property and the impact resistance is concerned because of the thickness of 3.0 mm or greater, it was confirmed that the superior load life property and impact resistance were achieved similarly to the sample (sample 13) whose thickness T is less than 3.0 mm.

Furthermore, it became clear that, out of the samples (samples 16 to 19) whose C/D only is different, the samples (samples 17 and 18) satisfying $0.80 \leq C/D \leq 1.20$ have a quite superior impact resistance. The following reason can be considered. The reduced difference in the hardness between the base portion and the small-diameter portion allows for a smaller amplitude of the terminal electrode even when the terminal electrode vibrates with the front end of the terminal electrode being a support. This allows for the suppression of the contact of the terminal electrode to the inner circumference surface of the insulator during the vibration.

In addition, it was confirmed that, in the samples (samples 21 to 24) whose content of the conductive metal is 50% by weight to 60% by weight out of the samples (samples 20 to 25) whose content of the metal in the rear end side glass seal layer only is different, both of the load life property and the impact resistance are further improved. The following reasons can be considered. Since the content of the metal is 50% by weight or greater, the excessive reduction of the viscosity of the glass powder mixture when heated can be prevented, which results in the proper amount of the glass powder mixtures which moves around to the outer circumference side of the terminal electrode. Furthermore, since the content of the metal is 60% by weight or less, the glass powder contained in the glass powder mixture can be easily crushed when compressed by the terminal electrode. The synergetic effect of the above allows for further increased densities of the resistor and the rear end side glass seal layer.

Furthermore, it has been found that, in the samples (samples 26 to 28) having the pore rate of 0.92% or less out of the samples (samples 26 to 30) in which the pore rate in the recess facing part only is different, both of the load life property and the impact resistance are further enhanced. The following reasons can be considered. First, the pressure is applied to the resistor composition in the hot press process, which causes the density of the resistor to further increase. Second, the further increased contact area per unit area between the front end face of the terminal electrode and the rear end side glass seal layer allows for further improved fixing strength of the terminal electrode to the insulator via the rear end side glass seal layer.

According to the results of the tests described above, it is preferable that the recess part and the flat part are provided to the front end of the terminal electrode and that the terminal electrode (the spark plug) is configured so as to satisfy $0.52 \leq B/A \leq 0.91$, in order to achieve good performance in both of the load life property and the impact resistance.

In addition, in order to further improve the impact resistance, it is more preferable that $0.80 \leq C/D \leq 1.20$ is satisfied.

Moreover, in terms of further improvement of both load life property and impact resistance, it is more preferable that the content of the metal in the rear end side glass seal layer is greater than or equal to 50% by weight and less than or equal to 60% by weight.

In addition, in order to achieve further superior load life property and impact resistance, it is more preferable that the pore rate in the recess facing part of the rear end side glass seal layer is less than or equal to 0.92%.

Further, it is generally said to be difficult to secure good load life property and impact resistance when the length L is 50 mm or greater or when the thickness T of the insulator is 3.0 mm or greater. In contrast, employing the above-described configuration (in which the recess part and the flat part are provided to the front end of the terminal electrode and $0.52 \leq B/A \leq 0.91$ is satisfied) can ensure to achieve good load life property and impact resistance. In other words, the above-described configuration is particularly useful for the spark plug with the length L of 50 mm or greater and/or the spark plug with the insulator thickness T of 3.0 mm or greater.

It is noted that, without limited to the disclosure of the above-described embodiments, the following embodiments may be possible, for example. Of course, other applications and modifications not exemplified in the followings are also possible.

Figure 8A:
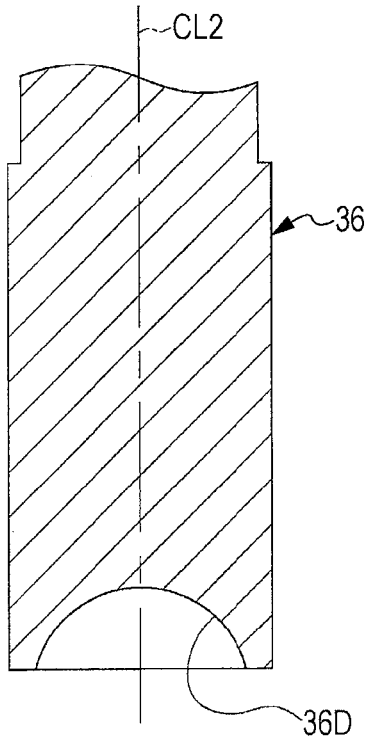
FIG. 8A is an expanded sectional view showing a recess part in another embodiment.
Figure 8B:
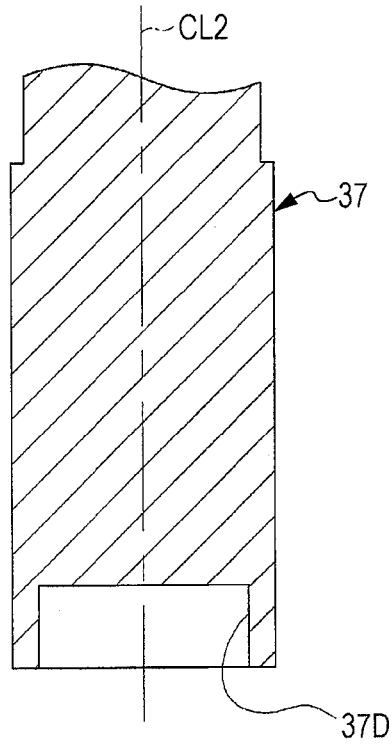
FIG. 8B is an expanded sectional view showing a recess part in yet another embodiment.

(a) In the above-described embodiments, the recess part 6D is shaped in a taper. However, the shape of the recess part is not limited to it. Thus, for example, as shown in FIG. 8A, the recess part 36D may be configured such that the outline of the inner surface of the terminal electrode 36 defining the recess part 36D is shaped in a curve in a cross section of the terminal electrode including the center axis CL2. Further, as shown in FIG. 8B, the terminal electrode 37 may be configured such that the recess part 37D has a constant inner diameter along the center axis CL2 direction.

Figure 9:
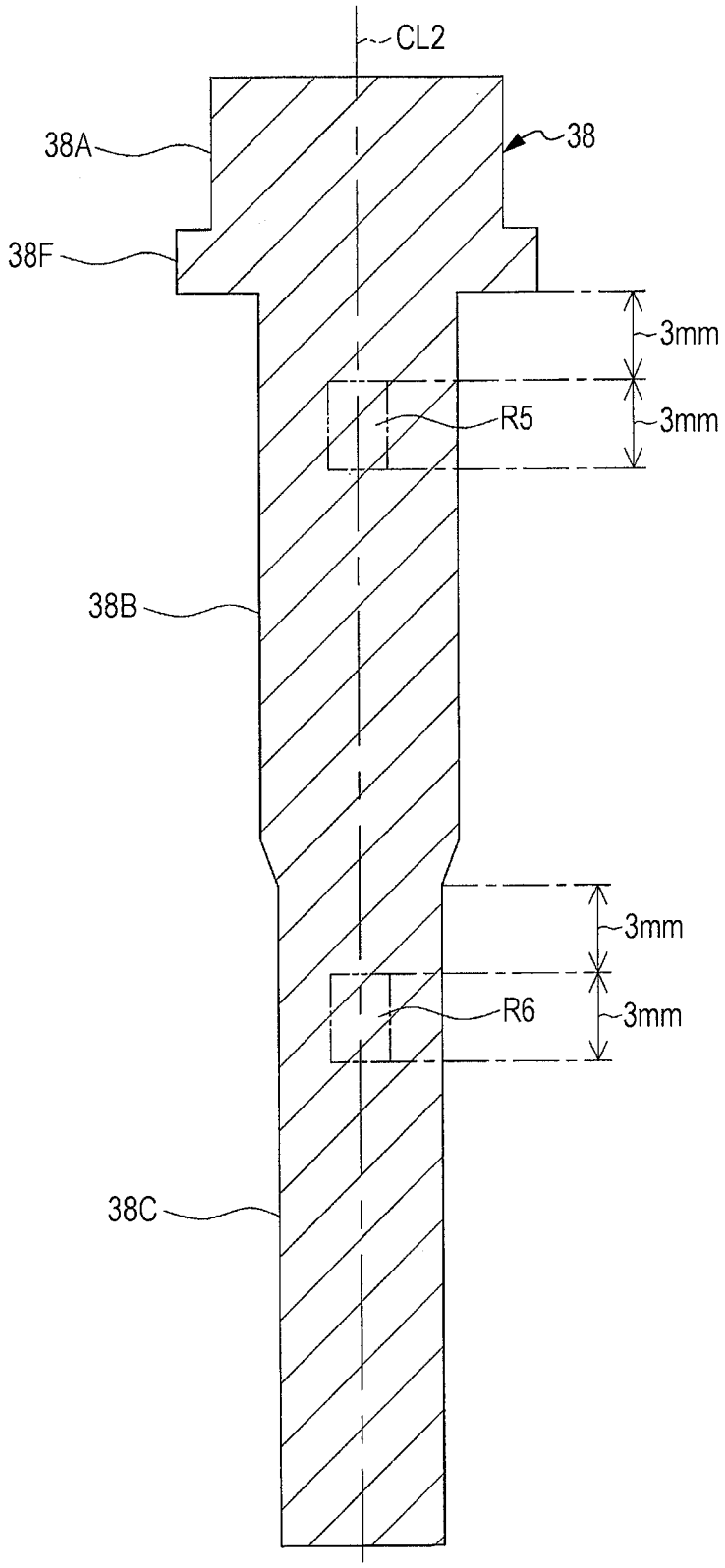
FIG. 9 is an expanded sectional view showing a terminal electrode in a further embodiment.

(b) The shape of the terminal electrode is not limited to the shape according to the above-described embodiments. For example, as shown in FIG. 9, the terminal electrode 38 may be configured such that the length along the center axis CL2 of the head portion 38A is relatively short. This length is a length of the part (that is, the head portion 38A) located between the rear end of the terminal electrode 38 and the front end of the flange portion 38F protruding outward in the radial direction. It is noted that the hardness of the base portion 38B (the Vickers hardness C) is defined as, for example, the averaged hardness for the ten points within a region R5 described later. FIG. 9 shows a cross section of the terminal electrode 38 including the center axis CL2. The region R5 is a region within the base portion 38B and with a width of 2 mm and a length of 3 mm that is located 3 mm away from the front end of the flange portion 38F in the center axis CL2 direction to the front end side. Further, the hardness of the small-diameter portion 38C (the Vickers hardness D) is defined as, for example, the averaged hardness for the ten points within a region R6 described later. FIG. 9 shows a cross section of the terminal electrode 38 including the center axis CL2. The region R6 is a region within the small-diameter portion 38C and with a width of 2 mm and a length of 3 mm that is located 3 mm away from the front end of the base portion 38B in the center axis CL2 direction to the front end side.

(c) The spark plug 1 according to the above-described embodiment is configured such that the axial line CL1 corresponds to the center axis CL2. However, the axial line CL1 may not necessarily correspond to the center axis CL2. For example, when the terminal electrode 6 is slightly bent in the hot press process, the center axis CL2 may shift with respect to the axial line CL1.

(d) In the above-described embodiment, the art of the present disclosure is embodied for the case where the ground electrode 27 is connected to the front end 26 of the metallic shell 3. Without limited to it, however, the art of the present disclosure is applicable to a spark plug having the ground electrode formed by cutting out a part of the metallic shell (or a part of the front end metal shell welded in advance to the metallic shell) (see, for example, JP-A-2006-236906).

(e) In the above-described embodiment, the sectional shape of the tool engagement portion 19 is a hexagon. However, the shape of the tool engagement portion 19 is not limited to such shape. The shape of the tool engagement portion 19 may be the Bi-HEX (the irregular dodecagon) shape (ISO22977: 2005(E)), for example.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A spark plug comprising:

an insulator having an axial hole penetrating the insulator in an axial line direction;

a terminal electrode inserted in a rear end side of the axial hole;

a center electrode inserted in a front end side of the axial hole;

a resistor disposed between the terminal electrode and the center electrode within the axial hole and containing a conductive material and glass; and a glass seal layer disposed in the rear end side of the resistor within the axial hole, said glass seal layer contacting a front end of the terminal electrode and containing a conductive material and glass; wherein the terminal electrode has, at its front end: a recess part opened to the front end side and having a depth of 0.3 mm or greater in a center axis direction of the terminal electrode; and a flat part neighboring the recess part at its outer circumference side, and wherein $0.52 \leq B/A \leq 0.91$ is satisfied, where A ($mm^2$) represents an area of a region surrounded by an outline forming an outer circumference surface of the terminal electrode, and B ($mm^2$) represents an area of a region of the terminal electrode surrounded by an outline of an inner surface forming the recess part in a cross section of the terminal electrode, the cross section being orthogonal to the center axis and located 0.1 mm away from a front end along the center axis to the rear end side.

2. The spark plug according to claim 1, wherein the terminal electrode includes: a head portion exposed from a rear end of the insulator; a base portion extending from a front end of the head portion toward the front end side; and a small-diameter portion located in the front end side than the base portion and having an outer diameter that is smaller than an outer diameter of the base portion, and wherein $0.80 \leq C/D \leq 1.20$ is satisfied, where C (Hv) represents hardness in Vickers hardness of the base portion and D (Hv) represents hardness in Vickers hardness of the small-diameter portion.

3. The spark plug according to claim 1, wherein the terminal electrode includes a head portion exposed from a rear end of the insulator, and a length along the center axis direction from a front end of the head portion to the front end of the terminal electrode is greater than or equal to 50 mm.

4. The spark plug according to claim 1, wherein a thickness of the insulator is greater than or equal to 3.0 mm in a cross section that passes the front end of the terminal electrode and is orthogonal to the axial line.

5. The spark plug according to claim 1, wherein the conductive material is a metal and a content of the metal in the glass seal layer is greater than or equal to 50% by weight and less than or equal to 60% by weight.

6. The spark plug according to claim 1, wherein, in a cross section including the axial line, a pore rate of the glass seal layer in a region is less than or equal to 0.92%, said region being surrounded by a first virtual line that passes the front end of the terminal electrode and is orthogonal to the axial line, a second virtual line that is located 1.0 mm away from the first virtual line to the front end side along the axial line and is orthogonal to the axial line, a third virtual line that passes a point 0.5 mm away from an intermediate point of two intersections, which are made by an outline of the axial hole and the first virtual line, to one side along a direction orthogonal to the axial line and extends in the axial line direction, and a fourth virtual line that passes a point 0.5 mm away from the intermediate point to the other side along the direction orthogonal to the axial line and extends in the axial line direction.

* * * * *